US011715477B1

(12) United States Patent
Griffin et al.

(10) Patent No.: US 11,715,477 B1
(45) Date of Patent: Aug. 1, 2023

(54) SPEECH MODEL PARAMETER ESTIMATION AND QUANTIZATION

(71) Applicant: Digital Voice Systems, Inc., Westford, MA (US)

(72) Inventors: Daniel W. Griffin, Hollis, NH (US); John C. Hardwick, Acton, MA (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

(21) Appl. No.: 17/716,805

(22) Filed: Apr. 8, 2022

(51) Int. Cl.

| | |
|---|---|
| ***G10L 19/087*** | (2013.01) |
| ***G10L 19/038*** | (2013.01) |
| ***G10L 25/21*** | (2013.01) |
| *G10L 19/00* | (2013.01) |
| *G10L 19/18* | (2013.01) |

(52) U.S. Cl.
CPC ..... *G10L 19/038* (2013.01); *G10L 25/21* (2013.01); *G10L 19/087* (2013.01); *G10L 19/18* (2013.01); *G10L 2019/0002* (2013.01)

(58) Field of Classification Search
CPC ..... G10L 19/087; G10L 19/18
See application file for complete search history.

(56) References Cited

U.S. PATENT DOCUMENTS 6,691,084 B2 * 2/2004 Manjunath ..... G10L 19/24 704/214
6,912,495 B2 * 6/2005 Griffin ..... G10L 19/087 704/214
6,963,833 B1 * 11/2005 Singhal ..... G10L 25/90 704/207

* cited by examiner

*Primary Examiner* — Feng-Tzer Tzeng
(74) *Attorney, Agent, or Firm* — Fish & Richardson P.C.

(57) ABSTRACT

Quantizing speech model parameters includes, for each of multiple vectors of quantized excitation strength parameters, determining first and second errors between first and second elements of a vector of excitation strength parameters and, respectively, first and second elements of the vector of quantized excitation strength parameters, and determining a first energy and a second energy associated with, respectively, the first and second errors. First and second weights for, respectively, the first error and the second error, are determined and are used to produce first and second weighted errors, which are combined to produce a total error. The total errors of each of the multiple vectors of quantized excitation strength parameters are compared and the vector of quantized excitation strength parameters that produces the smallest total error is selected to represent the vector of excitation strength parameters.

30 Claims, 11 Drawing Sheets

SPEECH MODEL PARAMETER ESTIMATION AND QUANTIZATION

TECHNICAL FIELD

This description relates generally to processing of digital speech.

BACKGROUND

Speech models together with speech analysis and synthesis methods are widely used in applications such as telecommunications, speech recognition, speaker identification, and speech synthesis. Vocoders, which have been extensively used in practice, are a class of speech analysis/synthesis systems based on an underlying model of speech. Examples of vocoders include linear prediction vocoders, homomorphic vocoders, channel vocoders, sinusoidal transform coders (STC), multiband excitation (MBE) vocoders, improved multiband excitation (IMBE™), and advanced multiband excitation vocoders (AMBE™).

Vocoders may be employed in telecommunications systems, such as mobile radio and cellular telephony, that transmit voice as digital data. Since transmission bandwidth is limited in these systems, the vocoder compresses the voice data to reduce the data that must be transmitted. Similarly, speech recognition, speaker identification, and speech synthesis systems, as well as other voice recording and storage applications, may use digital voice data with a vocoder to reduce the amount of data that must be stored per unit time. In such systems, an analog voice signal from a microphone is converted into a digital waveform using an Analog-to-Digital converter to produce a sequence of voice samples that are processed for further use.

In traditional telephony applications, speech is limited to 3-4 kHz of bandwidth and a sample rate of 8 kHz is used. In higher bandwidth applications, a corresponding higher sampling rate (such as 16 kHz or 32 kHz) may be used. The digital voice signal (i.e., the sequence of voice samples) is processed by the vocoder to reduce the overall amount of voice data. For example, a voice signal that is sampled at 8 kHz with 16 bits per sample results in a total voice data rate of 8,000×16-128,000 bits per second (bps), and a vocoder can be used to reduce the bit rate of this voice signal to rates of 2,000-8,000 bps (i.e., where 2,000 bps is a compression ratio of 64 and 8000 bps is a compression rate of 16) being achievable while still maintaining reasonable voice quality and intelligibility. Such large compression ratios are due to the large amount of redundancy within the voice signal and the inability of the ear to discern certain types of distortion. The result is that the vocoder forms a vital part of most modern voice communications systems where the reduction in data rate conserves precious RF spectrum and provides economic benefits to both service providers and users.

A vocoder is divided into two primary functions: (i) an encoder that converts an input sequence of voice samples into a low-rate voice bit stream; and (ii) a decoder that reverses the encoding process and converts the low-rate voice bit stream back into a sequence of voice samples that are suitable for playback via a digital-to-analog converter and a loudspeaker or for other processing.

SUMMARY

In one general aspect, a method of quantizing speech model parameters is provided. The method includes, for each of multiple vectors of quantized excitation strength parameters, determining a first error between a first element of a vector of excitation strength parameters and a first element of the vector of quantized excitation strength parameters, and determining a second error between a second element of the vector of excitation strength parameters and a second element of the vector of quantized excitation strength parameters. A first energy associated with the first error and a second energy associated with the second error are determined, and a first weight for the first error and a second weight for the second error are determined, such that, when the first energy is larger than the second energy, the ratio of the first weight to the second weight is less than the ratio of the first energy to the second energy, and, when the second energy is larger than the first energy, the ratio of the second weight to the first weight is less than the ratio of the second energy to the first energy. The first error is weighted using the first weight to produce a first weighted error and the second error is weighted using the second weight to produce a second weighted error, and the first weighted error and the second weighted error are combined to produce a total error. The total errors of each of the multiple vectors of quantized excitation strength parameters are compared, and the vector of quantized excitation strength parameters that produces the smallest total error is selected to represent the vector of excitation strength parameters.

Implementations may include one or more of the following features. For example, determining the first weight and the second weight may include applying a nonlinearity to the first energy and the second energy, respectively. The nonlinearity may be a power function with an exponent between zero and one.

The first element of the vector of excitation strength parameters may correspond to an associated frequency band and time interval, and the first weight may depend on an energy of the associated frequency band and time interval and an energy of at least one other frequency band or time interval. The first weight may be increased when an excitation strength is different between the associated frequency band and time interval and the at least one other frequency band or time interval.

The vector of excitation strength parameters may include a voiced strength/pulsed strength pair, and the first weight may be selected such that the error between a high voiced strength/low pulsed strength pair and a quantized low voiced strength/high pulsed strength pair is less than the error between the high voiced strength/low pulsed strength pair and a quantized low voiced strength/low pulsed strength pair.

The vector of excitation strength parameters may correspond to a MBE speech model.

In another general aspect, a method of estimating speech model parameters from a digitized speech signal, includes dividing the digitized speech signal into two or more frequency band signals. A first preliminary excitation parameter is determined using a first method that includes performing a nonlinear operation on at least two of the frequency band signals to produce at least two modified frequency band signals, weights to apply to the at least two modified frequency band signals are determined, and the first preliminary excitation parameter is determined using a first weighted combination of the at least two modified frequency band signals. A second preliminary excitation parameter is determined by applying weights corresponding to the weights determined in the first method to the at least two of the frequency band signals to form a second weighted combination of at least two frequency band signals and using a second method different from the first method to determine the second preliminary excitation parameter from the second weighted combination. The first and second preliminary excitation parameters are used to determine an excitation parameter for the digitized speech signal.

Implementations may include one or more of the following features. For example, determining the weights may include examining estimated background noise energy.

The method also may include determining a third preliminary excitation parameter by comparing energy near a peak frequency to total energy and using the first, second and third preliminary excitation parameters to determine the excitation parameter for the digitized speech signal. The peak frequency may be determined after excluding frequencies below a threshold level.

The third preliminary excitation parameter may be determined using a measure of periodicity over less than the full bandwidth of the digitized speech signal.

A fundamental frequency for the digitized speech signal may be determined. For example, a target frequency may be determined based on previous fundamental frequency estimates. A subharmonic of a current fundamental frequency may be selected based on proximity to the target frequency.

The first preliminary excitation parameter may be a fundamental frequency estimate, which may be determined by evaluating parameters for at least a first fundamental frequency estimate and a second fundamental frequency estimate. For example, a ratio of the parameter for the second fundamental frequency estimate may to the parameter for the first fundamental frequency estimate may be compared to a sequence of two or more threshold parameters. Success for a comparison may result in additional parameter tests and failure may result in comparing the ratio to the next threshold parameter in the sequence. Failure of the additional parameter tests also may result in comparing the ratio to the next threshold parameter in the sequence.

The techniques for quantizing speech model parameters discussed above and described in more detail below may be implemented by a speech coder. The speech coder may be included in, for example, a handset, a mobile radio, a base station or a console.

Other features will be apparent from the description and drawings, and from the claims.

DETAILED DESCRIPTION

Figure 1:
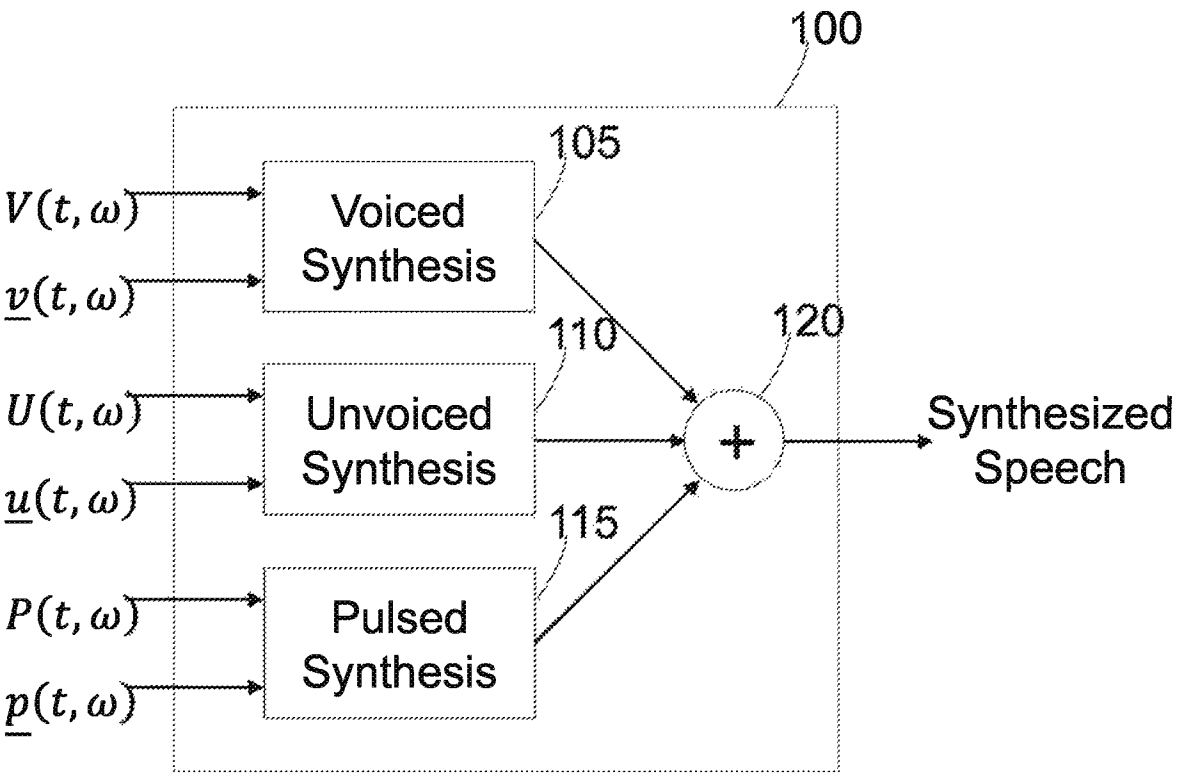
FIG. 1 is a block diagram of a speech synthesis system using a multi-band excitation speech model.

As discussed below, techniques are provided for improving speech coding and compression techniques that rely on quantization to encode speech in a way that permits the output of high quality speech even when faced with reduced transmission bandwidth or storage constraints. The techniques may be implemented with software. For example, the techniques may be incorporated in a vocoder that is implemented by, for example, a mobile radio or a cellular telephone.

Vocoders typically model speech over a short interval of time as the response of a system excited by some form of excitation. Typically, an input signal $s_0(n)$ is obtained by sampling an analog input signal. For applications such as speech coding or speech recognition, the sampling rate ranges typically between 6 kHz and 48 kHz. In general, the excitation model works well for any sampling rate with corresponding changes in the associated parameters. To focus on a short interval centered at time t, the input signal $s_0(n)$ is typically multiplied by a window w(t,n) centered at time t to obtain a windowed signal s(t,n). The window used is typically a Hamming window or Kaiser window and may be time invariant so that $w(t,n)=w_0(n-t)$ or may have characteristics which change as a function of time. The length of the window w(t,n) typically ranges between 5 ms and 40 ms. The windowed signal s(t,n) may be computed at center times of $t_0, t_1, \ldots, t_m, t_{m+1}, \ldots$, Typically, the interval between consecutive center times $t_{m+1}-t_m$ approximates the effective length of the window w(t,n) used for these center times. The windowed signal s(t,n) for a particular center time may be referred to as a segment or frame of the input signal.

For each segment of the input signal, system parameters and excitation parameters are determined. The system parameters typically model the spectral envelope or the impulse response of the system. The excitation parameters typically include a fundamental frequency (or pitch period) and a voiced/unvoiced (V/UV) parameter which indicates whether the input signal has pitch (or indicates the degree to which the input signal has pitch). For vocoders such as MBE, IMBE, and AMBE, the input signal is divided into frequency bands and the excitation parameters may also include a V/UV decision for each frequency band. High quality speech reproduction may be provided using a high quality speech model, accurate estimation of the speech model parameters, and high quality synthesis methods.

The Fourier transform of the windowed signal s(t,n) may be denoted by $S(t,\omega)$ and may be referred to as the signal Short-Time Fourier Transform (STFT). If s(n) is a periodic signal with a fundamental frequency $\omega_0$ or pitch period $n_0$, the parameters $\omega_0$ and $n_0$ are related to each other by $2\pi/\omega_0=n_0$. Non-integer values of the pitch period $n_0$ are often used in practice.

A speech signal $s_0(n)$ may be divided into multiple frequency bands using bandpass filters. Characteristics of these bandpass filters are allowed to change as a function of time and/or frequency. A speech signal may also be divided into multiple bands by applying frequency windows or weightings to the speech signal STFT $S(t,\omega)$.

Referring to FIG. 1, a speech synthesis system 100 may use the multi-band excitation speech model disclosed in U.S. Pat. No. 6,912,495, which is titled "Speech Model and Analysis, Synthesis, and Quantization Methods" and is incorporated by reference. This speech model augments the typical excitation parameters with additional parameters for higher quality speech synthesis. Speech synthesis system 100 includes a voiced synthesis unit 105 that receives a voiced strength $V(t,\omega)$ parameter and an associated vector of parameters $\underline{v}(t,\omega)$ and uses them to produce a quasi-periodic "voiced" audio signal, an unvoiced synthesis unit 110 that receives an unvoiced strength $U(t,\omega)$ parameter and an associated vector of parameters $\underline{u}(t,\omega)$ and uses them to produce a noise-like "unvoiced" audio signal, and a pulsed synthesis unit 115 that receives pulsed strength $P(t,\omega)$ parameters and an associated vector of parameters $\underline{p}(t,\omega)$ and uses them to produce a pulsed audio signal. A summation unit 120 adds the audio signals produced by these units to produce synthesized speech. Methods for synthesizing these three signals are disclosed in U.S. Pat. No. 6,912,495.

The voiced strength $V(t,\omega)$, unvoiced strength $U(t,\omega)$, and pulsed strength $P(t,\omega)$ parameters control the proportion of quasi-periodic, noise-like, and pulsed signals in each frequency band. These parameters are functions of time (t) and frequency ($\omega$). The voiced strength parameter $V(t,\omega)$ may vary between zero, which indicates that there is no voiced signal at time t and frequency $\omega$, and one, which indicates that the signal at time t and frequency $\omega$ is entirely voiced. The unvoiced strength and pulsed strength parameters provide similar indications. The excitation strength parameters may be constrained in the speech synthesis system so that they sum to one (i.e., $V(t,\omega)+U(t,\omega)+P(t,\omega)=1$).

The vector of parameters $\underline{v}(t,\omega)$ associated with the voiced strength parameter $V(t,\omega)$ includes voiced excitation parameters and voiced system parameters. The voiced excitation parameters may include a time and frequency dependent fundamental frequency $\omega_0(t,\omega)$ (or equivalently a pitch period $n_0(t,\omega)$).

The vector of parameters $\underline{u}(t,\omega)$ associated with the unvoiced strength parameter $U(t,\omega)$ includes unvoiced excitation parameters and unvoiced system parameters. The unvoiced excitation parameters may include, for example, statistics and energy distribution.

The vector of parameters $\underline{p}(t,\omega)$ associated with the pulsed excitation strength parameter $P(t,\omega)$ includes pulsed excitation parameters and pulsed system parameters. The pulsed excitation parameters may include one or more pulse positions $n_0(t,\omega)$ and amplitudes.

Figure 2:
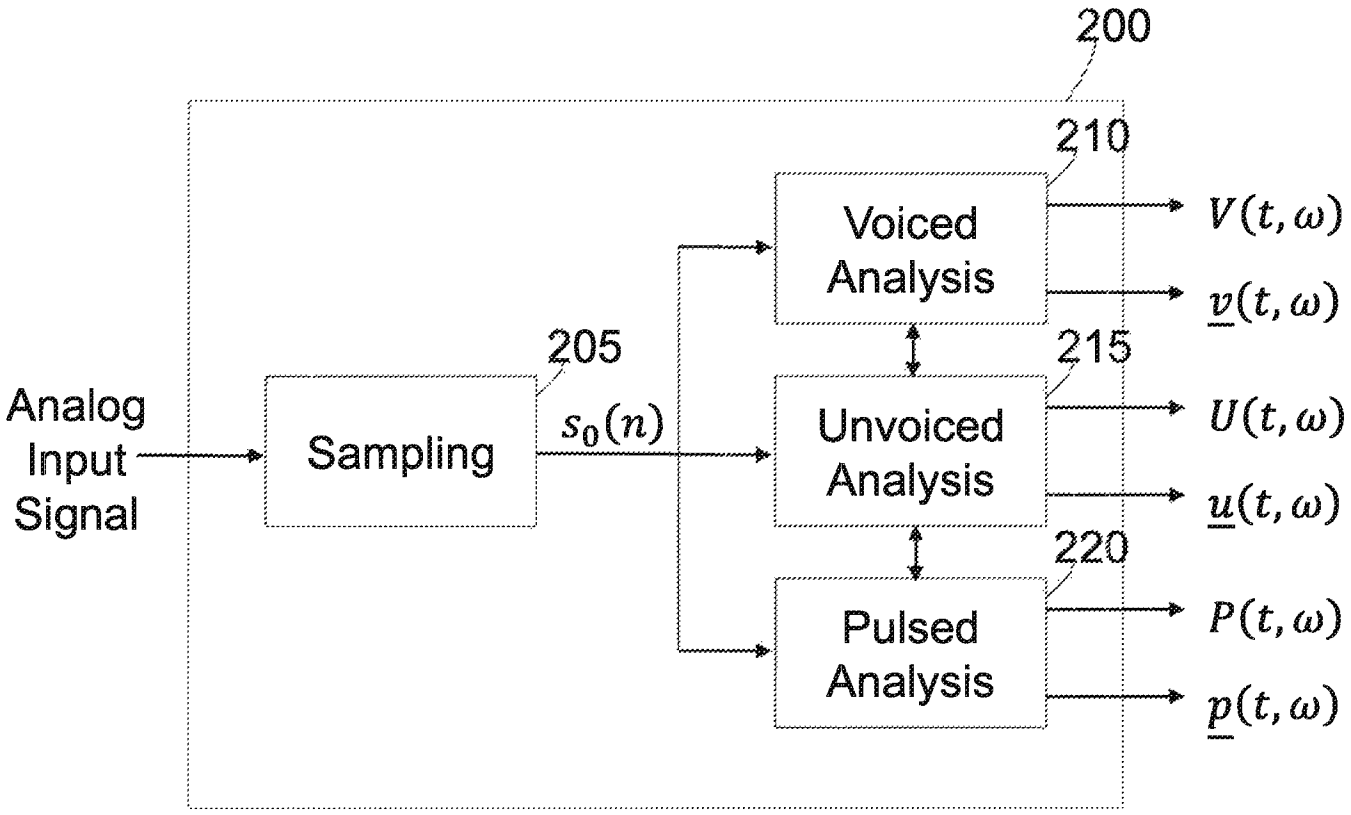
FIG. 2 is a block diagram of an analysis system for estimating parameters of the speech model of FIG. 1.

Referring to FIG. 2, a speech analysis system 200 estimates speech model parameters from an analog input signal. The speech analysis system 200 includes a sampling unit 205, a voiced analysis unit 210, an unvoiced analysis unit 215, and a pulsed analysis unit 220. The sampling unit 205 samples an analog input signal to produce a speech signal $s_0(n)$. It should be noted that sampling unit 205 may operate remotely from the analysis units in many applications. For typical speech coding or recognition applications, the sampling rate ranges between 6 kHz and 48 kHz. The voiced analysis unit 210 estimates the voiced strength $V(t,\omega)$ and the voiced parameters $\underline{v}(t,\omega)$ from the speech signal $s_0(n)$. The unvoiced analysis unit 215 estimates the unvoiced strength $U(t,\omega)$ and the unvoiced parameters $\underline{u}(t,\omega)$ from the speech signal $s_0(n)$. The pulsed analysis unit 220 estimates the pulsed strength $P(t,\omega)$ and the pulsed signal parameters $\underline{p}(t,\omega)$ from the speech signal $s_0(n)$. The vertical arrows between analysis units 210, 215, and 220 indicate that information flows between these units to improve parameter estimation performance. In some implementations, only the voiced strength and pulsed strength are estimated. The unvoiced strength may be inferred from the voiced and pulsed strengths.

Analysis units 210, 215, and 220 may use the analysis methods disclosed in U.S. Pat. No. 6,912,495. Voiced strength analysis generally involves determining how periodic the signal is in a frequency band and time interval. Pulsed strength analysis involves determining how pulse-like the signal is in a frequency band and time interval. The time interval for pulsed strength analysis is generally the frame length. For voiced strength analysis, a longer time interval is generally used to span multiple periods for low fundamental frequencies. So, for low fundamental frequencies it is possible to have periodic pulses over the voiced analysis time interval but only a single pulse in the pulsed analysis time interval. Consequently, it is possible for the analysis system to produce a high pulsed strength estimate and a high voiced strength estimate for the same frequency band and center time.

Figure 3:
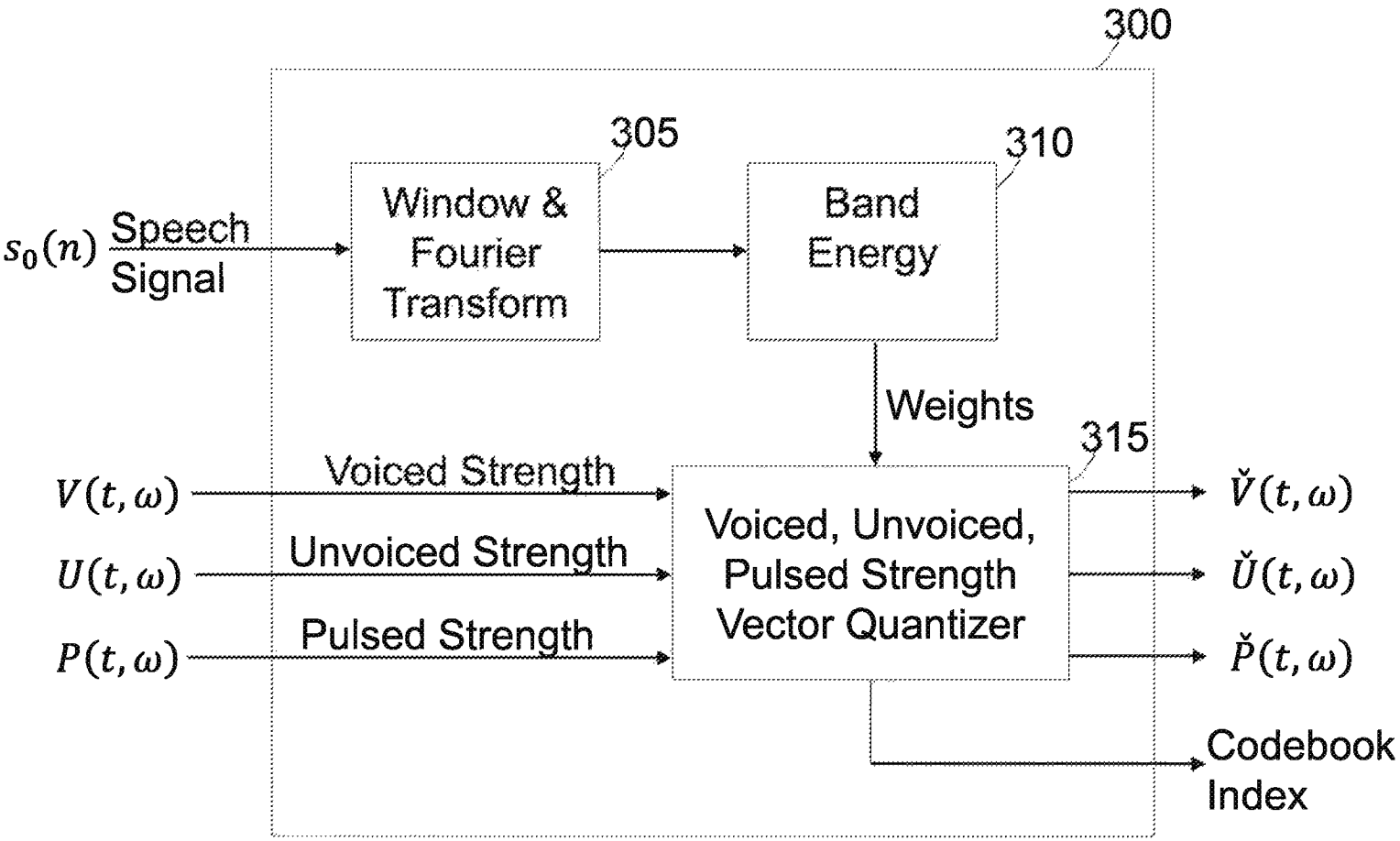
FIGS. 3 and 4 are block diagrams of excitation parameter quantization systems.

Referring to FIG. 3, an excitation parameter quantization system 300, such as that disclosed in U.S. Pat. No. 6,912,495, includes a window and Fourier transform unit 305, a band energy computation unit 310, and a voiced, unvoiced, pulsed strength vector quantizer unit 315. Excitation parameter quantization system 300 jointly quantizes the voiced strength $V(t,\omega)$, the unvoiced strength $U(t,\omega)$, and the pulsed strength $P(t,\omega)$ to produce the quantized voiced strength $\check{V}(t,\omega)$ the quantized unvoiced strength $\check{U}(t,\omega)$, and the quantized pulsed strength $\check{P}(t,\omega)$ using V/U/P strength vector quantizer unit 315. The window and Fourier transform unit 305 multiplies the input speech signal $s_0(n)$ by a window $w(t,n)$ centered at time t to obtain a windowed signal $s(t,n)$. The window used is typically a Hamming window or Kaiser window and is typically constant as a function of t so that $w(t,n)=w_0(n-t)$. The length of the window $w(t,n)$ typically ranges between 5 ms and 40 ms. The Fourier transform (FT) of the windowed signal $S(t,\omega)$ is typically computed using a fast Fourier transform (FFT) with a length greater than or equal to the number of samples in the window. When the length of the FFT is greater than the number of windowed samples, the additional samples of the FFT input are zeroed. The Fourier transform computed by unit 305 is divided into bands by unit 310 and the energy in each band is computed to generate weights for vector quantizer unit 315.

One implementation uses a weighted vector quantizer to jointly quantize the strength parameters from two adjacent frames using 7 bits. The strength parameters are divided into 8 frequency bands. Typical band edges for these 8 frequency bands for an 8 kHz sampling rate are 0 Hz, 375 Hz, 875 Hz, 1375 Hz, 1875 Hz, 2375 Hz, 2875 Hz, 3375 Hz, and 4000 Hz. The codebook for the vector quantizer contains 128 entries consisting of 16 quantized strength parameters for the 8 frequency bands of two adjacent frames. For each codebook index m, the error is evaluated using $$E_m = \sum_{n=0}^{1}\sum_{k=0}^{7}\alpha(t_n, \omega_k)E_m(t_n, \omega_k) \tag{1}$$

where $$E_m(t_n,\omega_k)=\max\{(V(t_n,\omega_k)-\check{V}_m(t_n,\omega_k))^2,(1-\check{V}_m(t_n,\omega_k))(P(t_n,\omega_k)-\check{P}_m(t_n,\omega_k))^2\}, \tag{2}$$

$\alpha(t_n,\omega_k)$ is a frequency and time dependent weighting typically set to the energy in the speech transform $S(t,\omega)$ around time $t_n$, and frequency $\omega_k$, max(a,b) evaluates to the maximum of a or b, and $\check{V}_m(t_n,\omega_k)$ and $\check{P}_m(t_n,\omega_k)$ are the quantized voice strength and quantized pulse strength. The error $E_m$ of Equation (1) is computed for each codebook index m and the codebook index which minimize $E_m$ is selected. To reduce storage in the codebook, the entries are quantized so that, for a particular frequency band and time index, a value of zero is used for entirely unvoiced, one is used for entirely voiced, and two is used for entirely pulsed. The quantized strength pair $(\check{V}_m(t_n,\omega_k), \check{P}_m(t_n,\omega_k))$ has the values (0, 0) for unvoiced, (1, 0) for voiced and (0, 1) for pulsed.

In another approach disclosed in U.S. Pat. No. 6,912,495, the error $E_m(t_n,\omega_k)$ of Equation (2) is replaced by $$E_m(t_n,\omega_k)=\gamma_m(t_n,\omega_k)+\beta(1-\check{V}_m(t_n,\omega_k))(1-\gamma_m(t_n,\omega_k))(P(t_n,\omega_k)-\check{P}_m(t_n,\omega_k))^2, \tag{3}$$

where $$\gamma_m(t_n,\omega_k)=(V(t_n,\omega_k)-\check{V}_m(t_n,\omega_k))^2$$

and $\beta$ is typically set to a constant of 0.5.

Listening tests of speech coding systems implemented using the methods disclosed in U.S. Pat. No. 6,912,495 indicate that quality may be increased while maintaining the same coding rate by improving on the error criteria in Equations (2) and (3). One aspect of these error criteria which may be improved relates to their behavior for quantizing a voiced strength, pulsed strength pair that has high voiced strength and low pulsed strength. When the error $E_m(t_n,\omega_k)$ of Equation (2) is evaluated for an unvoiced element in the codebook, it simplifies to $$E_U(t_n,\omega_k)=\max[V(t_n,\omega_k)^2,P(t_n,\omega_k)^2]. \quad (4)$$

When the error $E_m(t_n,\omega_k)$ of Equation (2) is evaluated for a pulsed element in the codebook, it simplifies to $$E_p(t_n,\omega_k)=\max[V(t_n,\omega_k)^2,(1-P(t_n,\omega_k))^2]. \quad (5)$$

Comparing these two errors leads to $$E_U(t_n,\omega_k)\leq E_p(t_n,\omega_k),\text{if } P(t_n,\omega_k)\leq ½. \quad (6)$$

So, there is no preference for a pulsed element in the codebook over an unvoiced element in the codebook for low pulsed strength ($P(t_n,\omega_k)\leq ½$).

Similarly, when the error $E_m(t_n,\omega_k)$ of Equation (3) is evaluated for an unvoiced element in the codebook, it simplifies to $$E_U(t_n,\omega_k)=V(t_n,\omega_k)^2+\beta(1-V(t_n,\omega_k)^2)P(t_n,\omega_k)^2. \quad (7)$$

When the error $E_m(t_n,\omega_k)$ of Equation (3) is evaluated for a pulsed element in the codebook, it simplifies to $$E_p(t_n,\omega_k)=V(t_n,\omega_k)^2+\beta(1-V(t_n,\omega_k)^2)(1-P(t_n,\omega_k))^2. \quad (8)$$

When $\beta<0$, unvoiced elements are preferred over pulsed elements for high pulsed strengths so this is not a useful operating region. When $\beta\geq 0$, comparing these two errors leads to $$E_U(t_n,\omega_k)\leq E_p(t_n,\omega_k),\text{if } P(t_n,\omega_k)\leq ½. \quad (9)$$

So, there is no preference for a pulsed element in the codebook over an unvoiced element in the codebook for low pulsed strength ($P(t_n,\omega_k)\leq ½$).

Listening tests indicate that preferring pulsed elements over unvoiced elements when voiced strength is high and pulsed strength is low improves the quality of the synthesized speech especially when the fundamental frequency is low. Based on these listening tests, an improved error criterion may be introduced:

$$E_m(t_n,\omega_k)=\check{V}_m(t_n,\omega_k)E_v(t_n,\omega_k)+\check{P}_m(t_n,\omega_k)E_p(t_n,\omega_k)+\check{U}_m(t_n,\omega_k)E_u(t_n,\omega_k), \quad (10)$$

where $$\check{U}_m(t_n,\omega_k)=(1-\check{V}_m(t_n,\omega_k))(1-\check{P}_m(t_n,\omega_k), \quad (11)$$

$$E_v(t_n,\omega_k)=1-\max(V_m(t_n,\omega_k),\mu P_m(t_n,\omega_k)), \quad (12)$$

$$E_p(t_n,\omega_k)=1-\max(\xi V_m(t_n,\omega_k),P_m(t_n,\omega_k)), \quad (13)$$

$$E_u(t_n,\omega_k)=\max(V_m(t_n,\omega_k),P_m(t_n,\omega_k)), \quad (14)$$

$$\mu=A\min(1,\omega_c/\omega_0), \quad (15)$$

$$\xi=B\min(1,\omega_c/\omega_0). \quad (16)$$

A is typically set to a constant of 0.8, B is typically set to a constant of 0.7, $\omega_c$ typically set to a constant of $2\pi/S$. S is the number of samples in a synthesis frame which is typically about 80 for a sampling rate of 8 kHz, and the function min(a,b) evaluates to the minimum of a or b. When the novel error criterion $E_m(t_n,\omega_k)$ of Equation (10) is evaluated for a pulsed element in the codebook, it simplifies to $E_p(t_n,\omega_k)$ of Equation (13). When it is evaluated for an unvoiced element in the codebook, it simplifies to $E_u(t_n,\omega_k)$ of Equation (14). So, a pulsed element is preferred over an unvoiced element for low pulsed strength and high voiced strength ($V_m(t_n,\omega_k)>1/(1+\xi)$). The threshold $1/(1+\xi)$ is ½ for fundamentals at or below the cutoff frequency $\Omega_c$ and approaches 1 as the fundamental increases above the cutoff. So, this error criterion achieves the behavior favored in listening tests.

Listening tests of speech coding systems implemented using the methods disclosed in U.S. Pat. No. 6,912,495 indicate that quality may also be increased while maintaining the same coding rate by improving the frequency and time dependent weighting $\alpha(t_n,\omega_k)$ in the error criterion of Equation (1). Listening tests indicate that setting the weights $\alpha(t_n,\omega_k)$ to the energy $e(t_n,\omega_k)$ in the speech transform $S(t,\omega)$ around time $t_n$, and frequency $\omega_k$ tends to overweight higher energy regions relative to lower energy regions. This issue is more of a problem when smaller codebooks are used at lower bit rates.

One method of reducing the weighting of a high energy region relative to a lower energy region is to set the weights $\alpha(t_n,\omega_k)$ to a nonlinear function $\lambda(\ )$ of the energy $e(t_n,\omega_k)$:

$$\alpha(t_n,\omega_k)=\lambda(e(t_n,\omega_k)), \quad (17)$$

where the nonlinear function has the property $$\frac{\lambda(e_1)}{\lambda(e_2)}<\frac{e_1}{e_2},\text{ for } e_1>e_2>0. \quad (18)$$

One set of nonlinear functions which satisfy the property of Equation (18) are the power functions with exponent between 0 and 1

$$\lambda(x)=x^p, 0<p<1. \quad (19)$$

In one implementation, the power function exponent p is set to ½.

In another implementation, the nonlinearity may not be applied to every frame. Typically, the nonlinearity of Equation (17) provides better quality when the energy at low frequencies is much higher than the energy at high frequencies. So, much of the quality improvement may be pined by only applying the nonlinearity when the ratio of energy at low frequencies to the energy at high frequencies is above a threshold. For example, in one implementation, the threshold is 10. The range of low frequencies may be 0-1000 Hz and the range of high frequencies may be 1000-4000 Hz.

Figure 4:
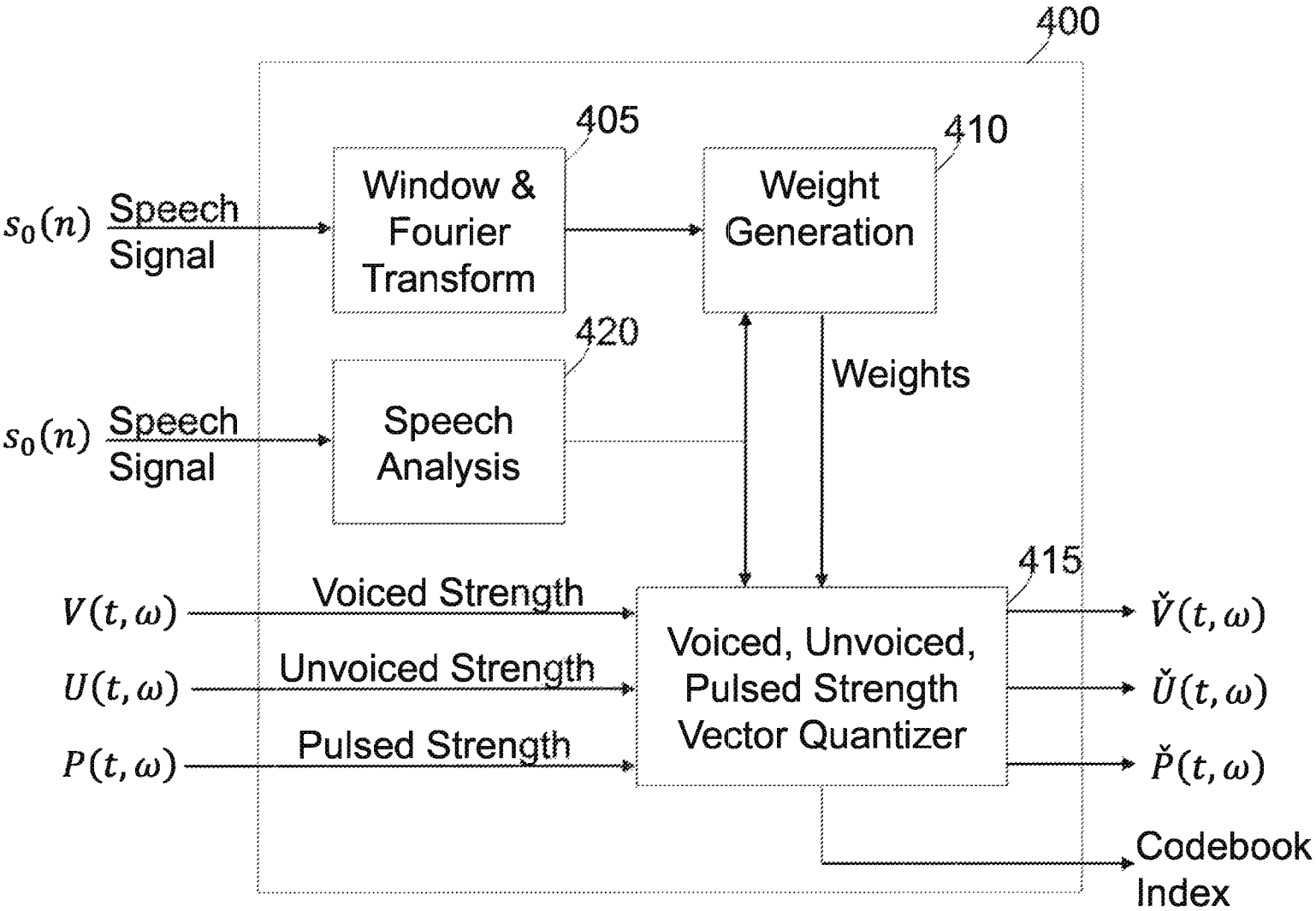

Referring to FIG. 4, an excitation parameter quantization system 400 includes a window and Fourier transform unit 405, a weight generation unit 410, a voiced, unvoiced, pulsed strength vector quantizer unit 415, and a speech analysis unit 420. The excitation parameter quantization system 400 jointly quantizes the voiced, unvoiced, and pulsed strengths to produce quantized strengths and the best codebook index. The window and Fourier transform unit 405 computes the Fourier transform of the windowed signal. The weight generation unit 410 divides the Fourier transform into bands and generates weights based on the energy in each band and parameters generated by the speech analysis unit 420. The vector quantizer unit 415 compares codebook entries to the input excitation strengths based on the weights from the weight generation unit 410 and the speech analysis parameters from the speech analysis unit 420 to determine the best codebook entry.

Figure 5:
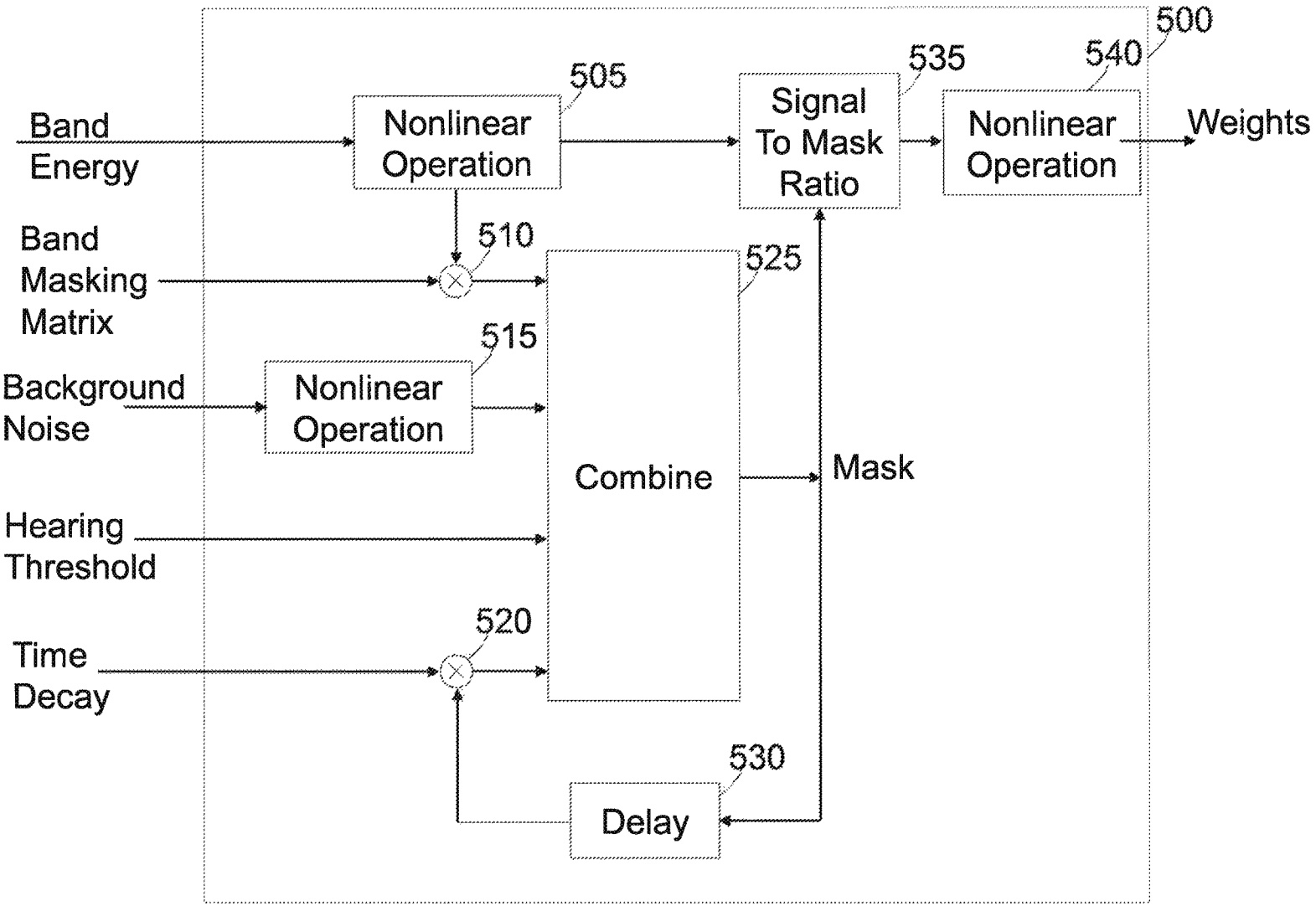
FIG. 5 is a block diagram of a weight generation system.

Listening tests indicate that quality may be further improved by including models of auditory system behavior in the weight generation unit. Referring to FIG. 5, a weight generation unit 500 includes a nonlinear operation unit 505, a matrix multiply unit 510, a nonlinear operation unit 515, a multiply unit 520, a combine unit 525, a delay unit 530, signal to mask ratio unit 535, and a nonlinear operation unit 540. The nonlinear operation unit 505 reduces the weighting of a high energy region relative to a low energy region by applying a nonlinear operation such as the power function of Equation (19). The matrix multiply unit 510 applies a band masking matrix to the output of the unit 505 to model frequency masking effects of the auditory system. The nonlinear operation unit 515 may use the same function as the unit 505 to reduce the weighting of a high energy region of a background noise energy estimate relative to a low energy region. The multiply unit 520 multiplies a delayed version of the mask produced by combine unit 525 by a time decay factor to model time masking effects of the auditory system. The combine unit 525 uses the outputs of units 510-520 and a hearing threshold to generate an estimate of the auditory system mask level. Signal to mask ratio unit 535 computes the ratio of the output of the unit 505 to the mask estimate. The nonlinear operation unit 540 limits the signal to mask ratio output and generates the weights.

The band masking matrix employed by the matrix multiply unit 510 models the frequency masking effects of the auditory system. The auditory system may be modeled as a filter bank consisting of band pass filters. Frequency masking experiments generally measure whether a band pass target signal at a target frequency and level is audible in the presence of a band pass masking signal at a masking frequency and level. The bandwidth of the auditory filters increases as the center frequency increases. In order to treat masking effects in a more uniform manner, it is useful to transform frequency f in Hz to the frequency e in units of Equivalent Rectangular Bandwidth Scale (ERBS):

$$\in = 21.4 * \log_{10}(1+0.00437f). \tag{20}$$

The frequency $\in$ of Equation (20) is an approximation to the number of equivalent rectangular bandwidths below the frequency f. One implementation of the band masking matrix is $$M_{jk} = \begin{cases} P\delta_p^{(\epsilon_d-\epsilon_p)}, & \epsilon_d > \epsilon_p \\ P\delta_n^{(\epsilon_n-\epsilon_d)}, & \epsilon_d < -\epsilon_n \\ \text{P, otherwise} \end{cases} \tag{21}$$

where $\in_d$ is the difference between the target frequency $\in_j$ and the masking frequency $\in_k$, P is the peak masking (typically a constant of 0.1122), $\in_p$ is the positive extent of the mask peak (typically a constant of 1.0), $\in_n$ is the negative extent of the mask peak (typically a constant of 0.2), $\Omega_p$ (typically a constant of 0.5) is the slope of the mask for frequencies above $\in_p$, and $\delta_n$ (typically a constant of 0.25) is the slope of the mask for frequencies below $\in_n$. Typical target and masking frequencies for an 8 band implementation sampled at 8 kHz are 125 Hz, 625 Hz, 1125 Hz, 1625 Hz, 2125 Hz, 2625 Hz, 3125 Hz, and 3625 Hz. These frequencies are transformed to the ERBS scale using Equation (20) to produce $\in_j$ and $\in_k$.

The band masking matrix of Equation (21) may be normalized to make the response more uniform as a function of frequency band:

$$M_{jk} = \frac{P}{\sum_k M_{jk}} M_{jk} \tag{22}$$

Listening tests for band-pass-filtered masks and target signals with unvoiced, voiced, or pulsed excitation characteristics indicate that mask levels are reduced when mask and target signals have different excitation types when compared to mask levels when mask and target signals have the same type. In addition, listening tests indicate that mask levels are reduced for low fundamental frequencies relative to high fundamental frequencies when one signal is voiced and the other is unvoiced. In one implementation, masks are corrected to address these issues as follows:

$$m_{jk} = 1 - \max((1-)|V(t_n,\omega_k) - V(t_n,\omega_j)|, (1-b)|P(t_n,\omega_k) - P(t_n,\omega_j)|) \tag{23}$$

where $$a = c_0(f_0 - f_1) + c_1, \tag{24}$$

b is typically a constant of 0.316, $f_0$ is the estimated fundamental frequency in Hz, $f_1$ is typically a constant of 125 Hz, $c_0$ is typically a constant of 0.001145, and $c_1$ is typically a constant of 0.316. These mask corrections may be applied to the band masking matrix of Equation (22) to produce an improved band masking matrix $$M_{jk} = m_{jk} M_{jk}. \tag{25}$$

The masking matrix may be applied to the output of nonlinear operation unit 505 $\lambda(e(t_n,\omega_k))$ with a traditional matrix multiply:

$$\mu_j = \Sigma_{k=0}^{7} M_{jk} \lambda(e(t_n,\omega_k)), j = 0, 1, \ldots, 7, \tag{26}$$

where $\mu_j$ is the output masking level of unit 52 for band j.

The nonlinear operation unit 515 applies the same nonlinearity as the nonlinear operation unit 505 to an estimate of the background noise energy in each band. The background noise energy estimate may be obtained using known methods such as those disclosed in U.S. Pat. No. 4,630,304 titled "Automatic Background Noise Estimator for a Noise Suppression System," which is incorporated by reference. The multiply unit 520 multiplies a time decay factor with a typical value of 0.4 by a delayed version of the output of the combine unit 525. The delay unit 530 has a typical delay of 10 ms. The combine unit 525 typically takes the maximum of its inputs to produce its output. The signal to mask ratio unit 535 divides the output of the nonlinear operation unit 505 by the output of the combine unit 525. The nonlinear operation unit 540 limits its output between a typical minimum of 0.001 and a typical maximum of 8.91. The weights $\alpha(t_n,\omega_k)$ of Equation (1) may be set to the output of weight generation unit 500 and used to find the best codebook index.

Figure 6:
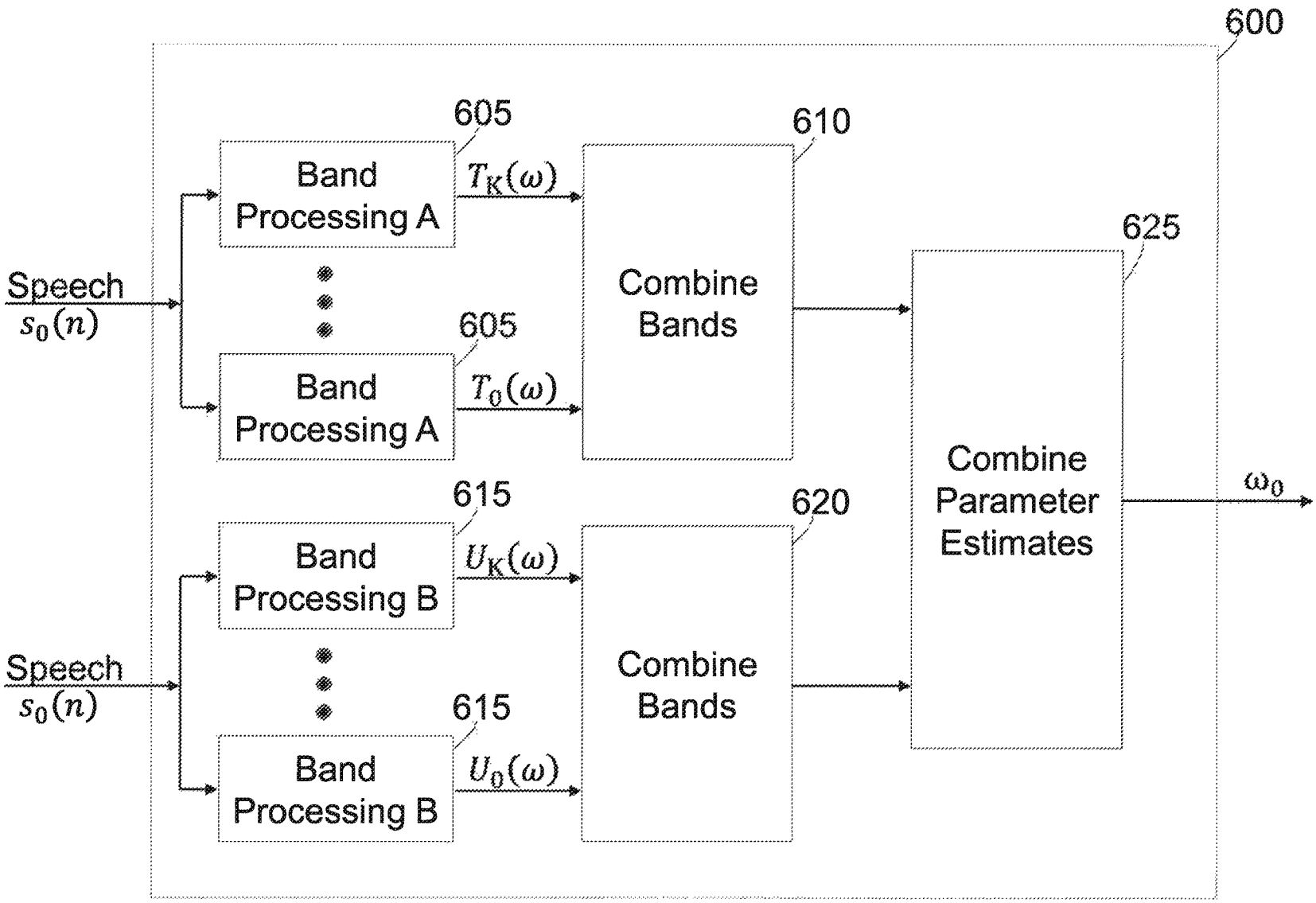
FIG. 6 is a block diagram of a fundamental frequency estimation system.

FIG. 6 shows a speech parameter analysis system 600 that estimates a fundamental frequency $\omega_0$ from a speech signal $s_0(n)$. The speech parameter analysis system 600 includes band processing A units 605, a combine bands unit 610, band processing B units 615, a combine bands unit 620, and a combine parameter estimates unit 625.

Band processing A units 605 may use known methods such as those disclosed in U.S. Pat. No. 5,826,222, titled "Estimation of Excitation Parameters," which is incorporated by reference. Band processing A units 605 divide the speech signal into different frequency bands using bandpass filters with different center frequencies. A nonlinearity is applied to the output of each bandpass filter to emphasize the fundamental frequency. The frequency domain signal $T_k(\omega)$ may be produced for frequency band k by applying a window, Fourier transform, and magnitude squared to the output of the nonlinearity.

The combine bands unit 610 combines the outputs of band processing A units 605 using a weighted summation. The weights may be computed by comparing the energy in a frequency band to an estimate of the background noise in that band to produce a signal to noise ratio (SNR). The weights may be determined from the estimated SNR so that weights are higher when the estimated SNR is higher. A fundamental frequency $\omega_A$ may be estimated from the weighted summation $T(\omega)$ along with a probability that the estimated fundamental frequency is correct $P_A$ or an error $E_A$ that indicates how close the combined frequency domain signal is to the spectrum of a periodic signal.

The band processing B units 615 use a method different from the band processing A units 605. For example, the B units may use the same bandpass filters as the A units. However, the frequency domain signal $U_k(\omega)$ may be produced for frequency band k by applying a window, Fourier transform, and magnitude squared to the output of the bandpass filters directly. In another implementation, frequency domain signal $U_k(\omega)$ may be produced by applying a window, Fourier transform, and magnitude squared to the speech signal $s_0(n)$ and then multiplying by a frequency domain window to select frequency band k.

Combine bands unit 620 combines the outputs of band processing B units 615 using a weighted summation $$U(\omega) = \sum_{k=0}^{K} \gamma_k U_k(\omega) \tag{27}$$

where $\gamma_k$ is a band weighting which should be similar to the band weighting selected for combine band unit 610 in order to improve performance of the combine parameter estimates unit 625. A fundamental frequency $\omega_B$ may be estimated from the weighted summation along with a probability that the fundamental frequency is correct $P_B$ or an error $E_B$ that indicates how close the combined frequency domain signal is to the spectrum of a periodic signal. In one implementation, fundamental frequency $\omega_B$ may be estimated by maximizing a voiced energy $$E_v(\omega_B) = \sum_{n=1}^{N} \sum_{\omega_m \in I_n} U(\omega_m) \tag{28}$$

where $I_n=[(n-\epsilon)\omega_B,(n+\epsilon)\omega_B]$ and $\epsilon$ has a typical value of 0.167 and N is the number of harmonics of the fundamental in the bandwidth W (typically 4 kHz). For example, the energy $E_v(\omega_B)$ may be evaluated for fundamental frequencies between 400 Hz and 720 Hz. The evaluation points may be uniform in frequency or log frequency with a typical number of 21. Accuracy may be increased by increasing the number of evaluation points at the expense of increased computation.

In another implementation, accuracy of the fundamental frequency estimate may be increased without additional evaluation points through the following iterative procedure $$\omega_B^n = \sum_{\omega_m \in I_n} \omega_m U(\omega_m) / \sum_{\omega_m \in I_n} n U(\omega_m) \tag{29}$$

where the initial estimate e starts at the evaluation point, $I_n=[n\omega_B^{n-1}-\epsilon\,\omega_B^0,\ n\omega_B^{n-1}+\epsilon\,\omega_B^0]$, and the fundamental estimate is updated at each harmonic. A fundamental frequency $\omega_B$ may be estimated from the weighted average of the estimates at each harmonic.

$$\omega_B = \sum_{n=1}^{N} \omega_B^n \sum_{\omega_m \in I_n} U(\omega_m) / \sum_{n=1}^{N} \sum_{\omega_m \in I_n} U(\omega_m) \tag{30}$$

The error $E_B$ may be computed using $$E_B = 1 - E_v(\omega_B)/E_U \tag{31}$$

where $$E_U = \sum_m U(\omega_m) \tag{32}$$

is the energy in $U(\omega)$ and the typical range of summation for m is zero to the largest value for which $\omega_m \le (N+0.5)\omega_B$.

Combine parameter estimates unit 625 combines the fundamental frequency estimates produced by combine band units 610 and 620 to produce an output fundamental frequency estimate $\omega_0$. In one implementation, the parameter estimates are combined by selecting fundamental frequency estimate $\omega_A$ when the probability $P_A$ that fundamental frequency estimate $\omega_A$ is correct is higher than the probability $P_B$ that fundamental frequency estimate $\omega_B$ is correct, and the fundamental frequency estimate $\omega_B$ is otherwise selected.

In another implementation, fundamental frequency estimate $\omega_A$ is selected when the error $E_A$ associated with fundamental frequency estimate $\omega_A$ is less than the error $E_B$ associated with fundamental frequency estimate $\omega_B$ and fundamental frequency estimate $\omega_B$ is otherwise selected.

In yet another implementation, fundamental frequency estimate $\omega_A$ is selected when the associated error $E_A$ is below a threshold with a typical value of 0.1, and otherwise fundamental frequency estimate $\omega_A$ is selected when the error $E_A$ associated with fundamental frequency estimate $\omega_A$ is less than the error $E_B$ associated with fundamental frequency estimate $\omega_B$ and fundamental frequency estimate $\omega_B$ is otherwise selected.

An output error $E_0$ may be set to correspond to the error associated with the selected fundamental frequency estimate.

Advantages of using similar band weightings for combine bands units 610 and 620 may be demonstrated by considering a scenario where one or more of the bands is dominated by high energy background noise (low SNR bands) and the other bands are dominated by harmonics of the fundamental for a speech signal (high SNR bands). For this case, even though combine bands unit 610 may have a better estimate of the fundamental frequency, it may have a larger error if the low SNR bands are weighted more heavily than combine bands unit 620. This larger error may lead to the selection of the less accurate estimate of combine bands unit 620 and reduced performance.

Combine parameter estimates unit 625 may use additional parameters to produce an output fundamental frequency estimate $\omega_0$. For example, in firefighting applications, voice communication may occur in the presence of loud tonal alarms. These alarms may have time varying frequencies and amplitudes which reduce the effectiveness of automatic background noise estimation methods. To improve performance in this case, the magnitude of the STFT $|S(t,\omega)|$ may be computed and, for a particular frame time t, the energy may be summed for a high frequency interval (typically 2-4 kHz) to form parameter $E_H$ which may be compared to the total energy in the frame $E_T$ to form a ratio $\tau_H=E_H/E_T$. In addition, a low pass version $E_{LB}$ of the error $E_B$ of Equation (31) may be computed using a bandwidth W of 2 kHz. When the ratio $r_H$ is above a threshold (typically 0.9) and $E_{LB}$ is above a threshold (typically 0.2) performance may be increased by ignoring fundamental frequency estimate $\omega_B$ in combine parameter estimates unit 625.

In another implementation, the magnitude of the STFT $|S(t,w)|$ may be computed and the frequency at which it achieves its maximum $\omega_p$ may be determined for a particular frame time t. The energy $E_p$ in an interval $\in_p$ (typically about 156 Hz wide) around the peak frequency $\omega_p$ may be compared to the total energy in the frame $E_T$ to form a ratio $r_p=E_p/E_T$. When the ratio $r_p$ is above a threshold (typically 0.7) and the peak frequency $\omega_p$ is above a threshold (typically 2 kHz), performance may be increased by ignoring fundamental frequency estimate $\omega_B$ in combine parameter estimates unit 625.

Quality of the synthesized signal may be improved in some cases by using additional parameters in combine parameter estimates unit 625 to produce a smoother output fundamental frequency estimate $\omega_0$ as a function of time. For example, when frequency estimate $\omega_B$ is preferred over $\omega_A$, the subharmonic l of fundamental frequency estimate $\omega_B$ may be selected as the output fundamental frequency estimate $\omega_0$ for the current frame if the subharmonic frequency $(\omega_B/l)$ is closer to a target frequency $\omega_T$.

In another implementation, thresholds $T_l=(l+0.5)\ \omega_T$ are determined based on the target frequency and the subharmonic number. When frequency estimate $\omega_B$ is selected over $\omega_A$, frequency estimate $\omega_B$ is compared to threshold $T_l$ for subharmonic number l=1, 2, 3, 4. The first subharmonic number for which the frequency estimate $\omega_B$ is less than the threshold $T_l$ is selected to compute the output fundamental frequency estimate $\omega_0=\omega_B/l$.

The target frequency $\omega_T$ may be selected as the previous output fundamental frequency estimate $\omega_0$ when the previous error $E_0$ is below a threshold (typically 0.2). Otherwise, the target frequency may be set to an average output fundamental frequency estimate $\overline{\omega_0}$.

An average output fundamental frequency estimate $\overline{\omega_0}$ may be set to a low pass filtered version of the sequence $\omega_0(t_n)$ where n is the frame index and $\alpha$ has a typical value of 0.7.

$$\overline{\omega_0}(t_{n+1})=\alpha\overline{\omega_0}(t_n)+(1-\alpha)\omega_0(t_n) \tag{33}$$

In another implementation, only samples of the sequence $\omega_0(t_n)$ with error $E_0(t_n)$ below a threshold (typically 0.1) are used in the computation of the average.

Quality of the synthesized signal may be improved in some cases by using additional parameters in combine parameter estimates unit 625 to select between fundamental frequency estimate $\omega_A$ and $\omega_A/2$ before combining with fundamental frequency estimate $\omega_B$.

Figure 7:
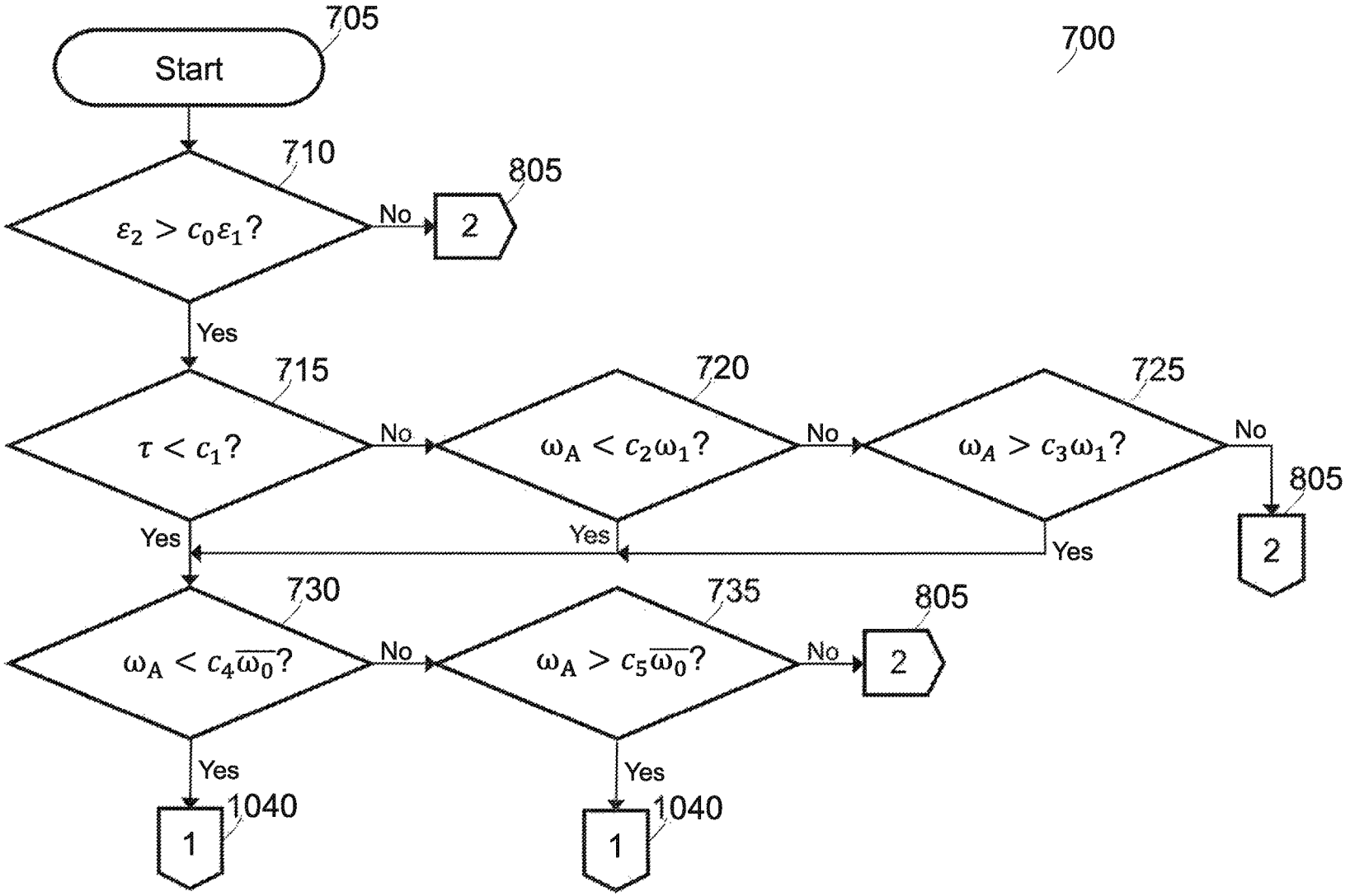
FIGS. 7-10 are flowcharts of a fundamental frequency estimation process.

FIGS. 7-10 show an example of a process for making this decision. Referring to FIG. 7, a sub-process 700 includes a start 705. In a first step 710, the voiced energy $\varepsilon_2$ for $\omega_A/2$ is compared to the product of constant $c_0$ (typically 1.85) and voiced energy $\varepsilon_1$ for $\omega_A$.

$$\varepsilon_1=\sum_{n=1}^{N}\sum_{\omega_m\in j_n}T(\omega_m) \tag{34}$$

where $I_n=[(n-\in)\omega_A,(n+\in)\omega_A]$, $\in$ has a typical value of 0.25, and N is the number of harmonics of the fundamental $\omega_A$ in the bandwidth $W_A$ (typically 500 Hz).

$$\varepsilon_2=\sum_{n=1}^{M}\sum_{\omega_m\in K_n}T(\omega_m) \tag{35}$$

where $K_n=[(n-\in)\omega_A/2,(n+E)\omega_A/2]$, $\in$ has a typical value of 0.25, and M is the number of harmonics of the fundamental $\omega_A/Z$ in the bandwidth $W_A$ (typically 500 Hz).

If the voiced energy $\varepsilon_2$ for $\omega_A/2$ is greater than the product of constant $c_0$ and voiced energy $\varepsilon_1$, the sub-process 700 proceeds to step 715. Otherwise, the sub-process 700 proceeds to step 805 of a sub-process 800 shown in FIG. 8.

In step 715, the fundamental track length $\tau$ is compared to a constant $c_1$(typically 3). The unit of the fundamental track length is typically frames and is initialized to zero. It measures the number of consecutive frames for which the fundamental frequency estimate deviates from the estimate in the previous frames by less than a percentage (typically 15%). If the fundamental track length s is less than the constant $c_1$, the sub-process 700 proceeds to step 730. Otherwise, the sub-process 700 proceeds to step 720.

In step 720, fundamental $\omega_A$ is compared with the product of constant $c_2$ (typically 0.9) and fundamental $\omega_1$ (typically set to the fundamental estimate $\omega_A$ from the previous frame). If the fundamental $\omega_A$ is less than the product of constant $c_2$ and fundamental $\omega_1$, the sub-process 700 proceeds to step 730. Otherwise, the sub-process 700 proceeds to step 725.

In step 725, fundamental $\omega_A$ is compared with the product of constant $c_3$ (typically 1.1) and fundamental $\omega_1$. If the fundamental $\omega_A$ is greater than the product of constant $c_3$ and fundamental $\omega_1$, the sub-process 700 proceeds to step 730. Otherwise, the sub-process 700 proceeds to step 805 of sub-process 800.

In step 730, fundamental $\omega_A$ is compared with the product of constant $c_4$ (typically 0.85) and average fundamental $\overline{\omega_0}$. If the fundamental $\omega_A$ is less than the product of constant $c_4$ and average fundamental $\overline{\omega_0}$, the sub-process 700 proceeds to step 1040 of a sub-process 1000 shown in FIG. 10. Otherwise, the sub-process 700 proceeds to step 735.

In step 735, fundamental $\omega_A$ is compared with the product of constant $c_5$ (typically 1.15) and average fundamental $\overline{\omega_0}$. If the fundamental $\omega_A$ is greater than the product of constant $c_5$ and average fundamental $\overline{\omega_0}$, the sub-process 700 proceeds to step 1040 of sub-process 1000. Otherwise, the sub-process 700 proceeds to step 805 of sub-process 800.

Figure 8:
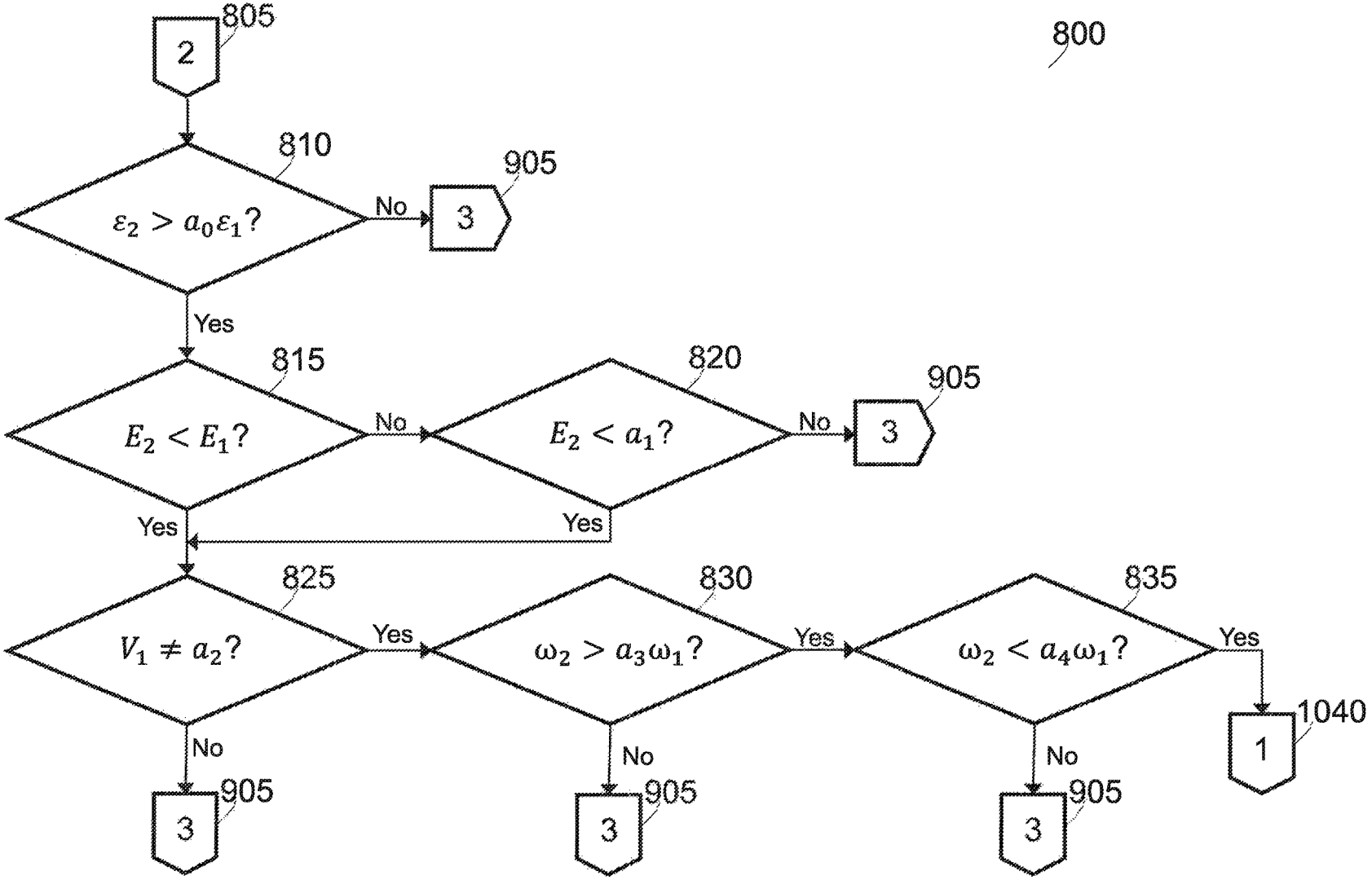

Referring to FIG. 8, sub-process 800 begins at step 805 and proceeds to step 810.

In step 810, voiced energy $\varepsilon_2$ is compared to the product of $a_0$ (typically 1.1) and voiced energy $\varepsilon_1$. If voiced energy $\varepsilon_2$ is greater than the product of $a_0$ and voiced energy $\varepsilon_1$, the sub-process 800 proceeds to step 815. Otherwise, the sub-process 800 proceeds to step 905 of a sub-process 900 shown in FIG. 9.

In step 815, the normalized voiced energy $E_2$ for the previous frame is compared to the normalized voiced energy $E_1$. The normalized voiced energy $E_1$ for a frame is calculated as:

$$E_1 = \varepsilon_1 / \sum_{\omega_m \in I} T(\omega_m) \tag{36}$$

where $I=[(1-\varepsilon)\omega_A, W_A]$, $\in$ has a typical value of 0.5, and bandwidth $W_A$ is typically 500 Hz. If the normalized voiced energy $E_2$ is less than the normalized voiced energy $E_1$, the sub-process 800 proceeds to step 825. Otherwise, the sub-process 800 proceeds to step 820.

In step 820, the normalized voiced energy $E_2$ for the previous frame is compared to a constant $a_1$ (typically 0.2). If the normalized voiced energy $E_2$ is less than $a_1$, the sub-process 800 proceeds to step 825. Otherwise, the sub-process 800 proceeds to step 905 of sub-process 900.

In step 825, $V_1$ (the voicing decisions for the previous frame) are compared to $a_2$ (typically all bands unvoiced). If they are not equal, the sub-process 800 proceeds to step 830. Otherwise, the sub-process 800 proceeds to step 905 of sub-process 900.

In step 830, fundamental $\omega_2$ (typically at to $\omega_A/2$) is compared to the product of constant $a_3$ (typically 0.8) and fundamental $\omega_1$ (typically set to the fundamental estimate $\omega_A$ from the previous frame). If fundamental $\omega_2$ is greater than the product of the product of constant $a_3$ and fundamental $\omega_1$, the sub-process 800 proceeds to step 835. Otherwise, the sub-process 800 proceeds to step 905 of sub-process 900.

In step 835, fundamental $\omega_2$ is compared to the product of constant $a_4$ (typically 1.2) and fundamental $\omega_1$. If fundamental $\omega_2$ is less than the product of constant $a_4$ and fundamental $\omega_1$, the sub-process 800 proceeds to step 905 of sub-process 900. Otherwise, the sub-process 800 proceeds to step 1040 of sub-process 1000.

Figure 9:
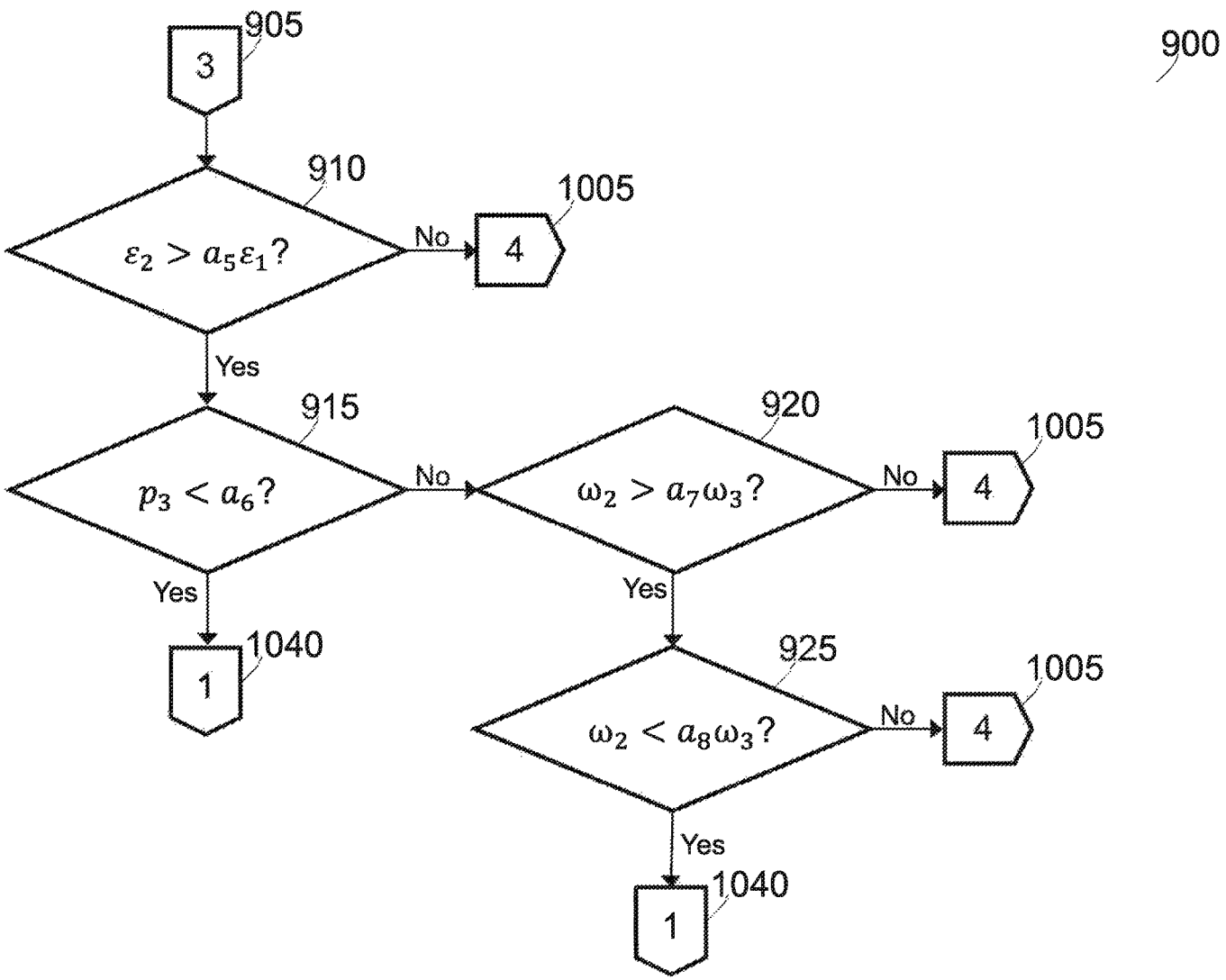

Referring to FIG. 9, sub-process 900 begins at step 905 and proceeds to step 910.

In step 910, voiced energy $\varepsilon_2$ is compared to the product of $a_s$ (typically 1.4-0.3$p_3$, where $p_3$ is the predicted fundamental valid) and voiced energy $\varepsilon_1$. The predicted fundamental valid $p_3$ ranges from 0 to 1 and is an estimate of the validity of a predicted fundamental $\omega_3$. One method for determining predicted fundamental valid $p_3$ initializes it to zero. Then, if normalized voiced energy $E_1$ is less than a constant (typically 0.2) and previous normalized voiced energy $E_2$ is less than a constant (typically 0.2) and fundamental track length $\tau$ is greater than a constant (typically 0), then predicted fundamental valid $p_3$ is set to one, otherwise it is multiplied by a constant (typically 0.9).

If voiced energy $\varepsilon_2$ is greater than the product of $a_5$ and voiced energy $\varepsilon_1$, the sub-process 900 proceeds to step 915. Otherwise, the sub-process 900 proceeds to step 1005 of sub-process 1000.

In step 915, predicted fundamental valid $p_3$ is compared to $a_6$ (typically 0.1). If predicted fundamental valid $p_3$ is leas than $a_6$, the sub-process 900 proceeds to step 1040 of sub-process 1000. Otherwise, the sub-process 900 proceeds to step 920.

In step 920, fundamental $\omega_2$ (typically set to $\omega_A/2$) is compared to the product of constant $a_7$ (typically 0.8) and predicted fundamental $\omega_3$. One method of generating predicted fundamental $\omega_3$ sets it to the current output fundamental frequency estimate $\omega_0$ when predicted fundamental valid $p_3$ is set to one. The predicted fundamental for the next frame may be increased by an estimated fundamental slope. One method of generating an estimated fundamental slope sets it to the difference between the current output fundamental frequency estimate $\omega_0$ and the output fundamental frequency for the previous frame when predicted fundamental valid $p_3$ is set to one. Otherwise, the estimated fundamental slope may be multiplied by a constant (typically 0.8).

If fundamental $\omega_2$ is greater than the product of constant $a_7$ and predicted fundamental $\omega_3$, the sub-process 900 proceeds to step 925. Otherwise, the sub-process 900 proceeds to step 1005 of sub-process 1000.

In step 925, fundamental $\omega_2$ is compared to the product of $a_8$ (typically 1.2) and predicted fundamental $\omega_3$. If fundamental $\omega_2$ is less than the product of constant $a_8$ and predicted fundamental $\omega_3$, the sub-process 900 proceeds to step 1040 of sub-process 1000. Otherwise, the sub-process 900 proceeds to step 1005 of sub-process 1000.

Figure 10:
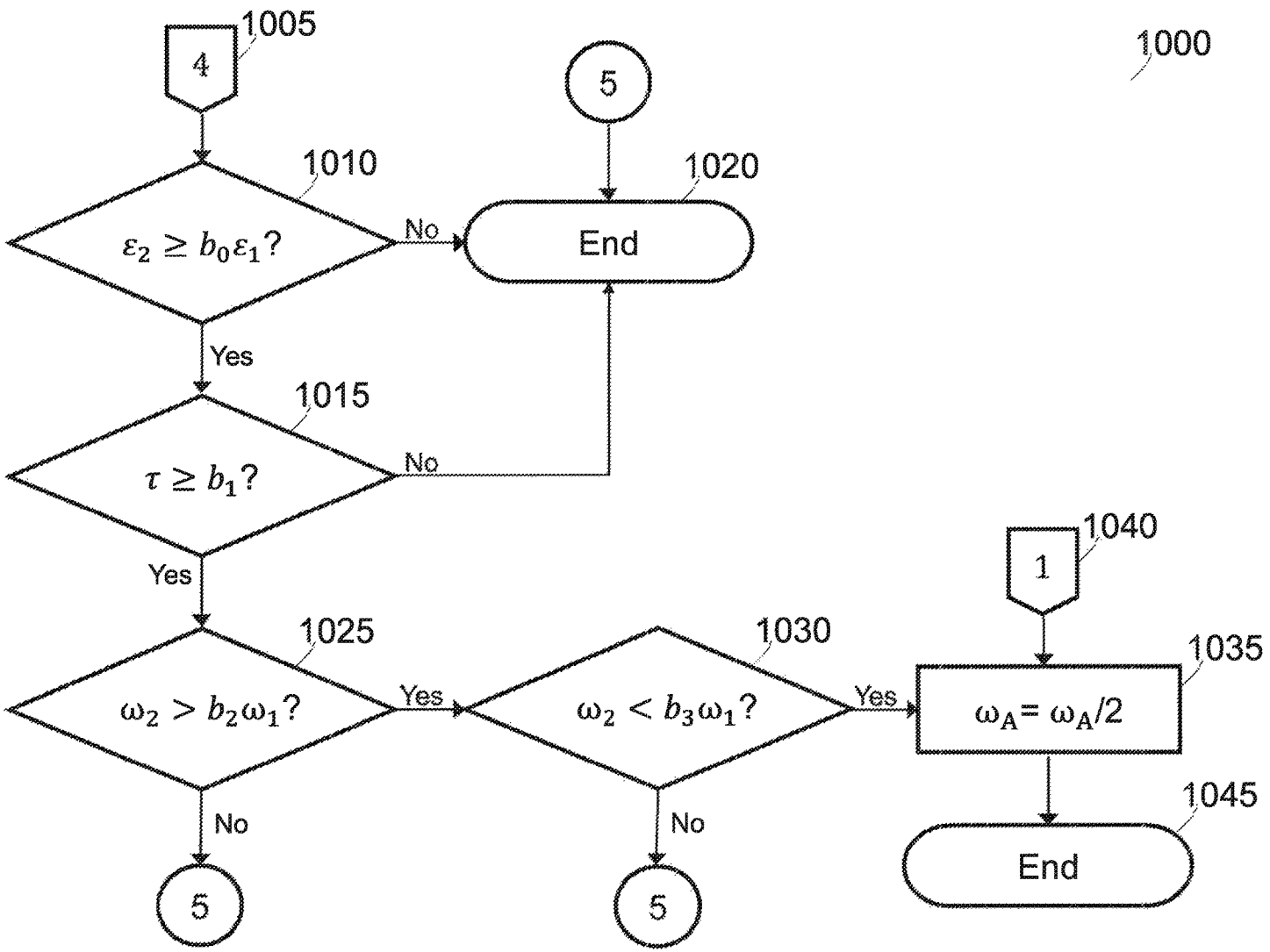

Referring to FIG. 10, sub-process 1000 begins at step 1005 and proceeds to step 1010.

In step 1010, voiced energy $\varepsilon_2$ is compared to the product of $b_0$ (typically 1.0) and voiced energy $\varepsilon_1$. If voiced energy $\varepsilon_2$ is greater than or equal to the product of $b_0$ (typically 1.0) and voiced energy $\varepsilon_1$, the sub-process 1000 proceeds to step 1015. Otherwise, the sub-process 1000 proceeds to step 1020, which ends the process with no change to fundamental $\omega_A$.

In step 1015, the fundamental track length $\tau$ is compared to $b_1$ (typically 3). If the fundamental track length $\tau$ is greater than or equal to $b_1$, the sub-process 1000 proceeds to step 1025. Otherwise, the sub-process 1000 proceeds to step 1020, which ends the process with no change to fundamental $\omega_A$.

In step 1025, fundamental $\omega_A$ (typically set to $\omega_A/2$) is compared with the product of constant $b_2$ (typically 0.8) and fundamental $\omega_1$ (typically set to the fundamental estimate $\omega_A$ from the previous frame). If fundamental $\omega_2$ is greater than the product of constant $b_2$ and fundamental $\omega_1$, the sub-process 1000 proceeds to step 1030. Otherwise, the sub-process 1000 proceeds to step 1020, which ends the process with no change to fundamental $\omega_A$.

In step 1030, fundamental $\omega_2$ is compared with the product of constant $b_3$ (typically 1.2) and fundamental $\omega_1$. If fundamental $\omega_2$ is less than the product of constant $b_3$ and fundamental $\omega_1$, the sub-process 1000 proceeds to step 1035. Otherwise, the sub-process 1000 proceeds to step 1020, which ends the process with no change to fundamental $\omega_A$.

In step 1035 (which is also reached from step 1040), fundamental $\omega_A$ is set to half its value and the sub-process proceeds to step 1045, which ends the process with the $\omega_A$ reduced by half.

The comparisons in steps 710, 810, 910, and 1010 could also be performed by computing the ratio of voiced energy $\varepsilon_2$ to voiced energy $\varepsilon_1$ and comparing that ratio to the parameters $c_0$, $a_0$, $a_5$, and $b_0$, respectively. The comparisons in steps 710, 810, 910, and 1010 provide computational benefits, ratio comparisons may be referenced for conceptual reasons. It should be noted that the overall structure of the process of FIGS. 7-10 is to compare this ratio to a sequence of threshold parameters ($c_0$, $a_0$, $a_5$, $b_0$). When this comparison is successful, additional parameter tests are performed. When this comparison fails, the ratio is compared to the next threshold parameter in the sequence. When the additional parameter tests are successful, fundamental $\omega_A$ is set to half its value, otherwise the ratio is compared to the next threshold parameter in the sequence. If there are no more threshold parameters in the sequence, fundamental $\omega_A$ is left unchanged.

Figure 11:
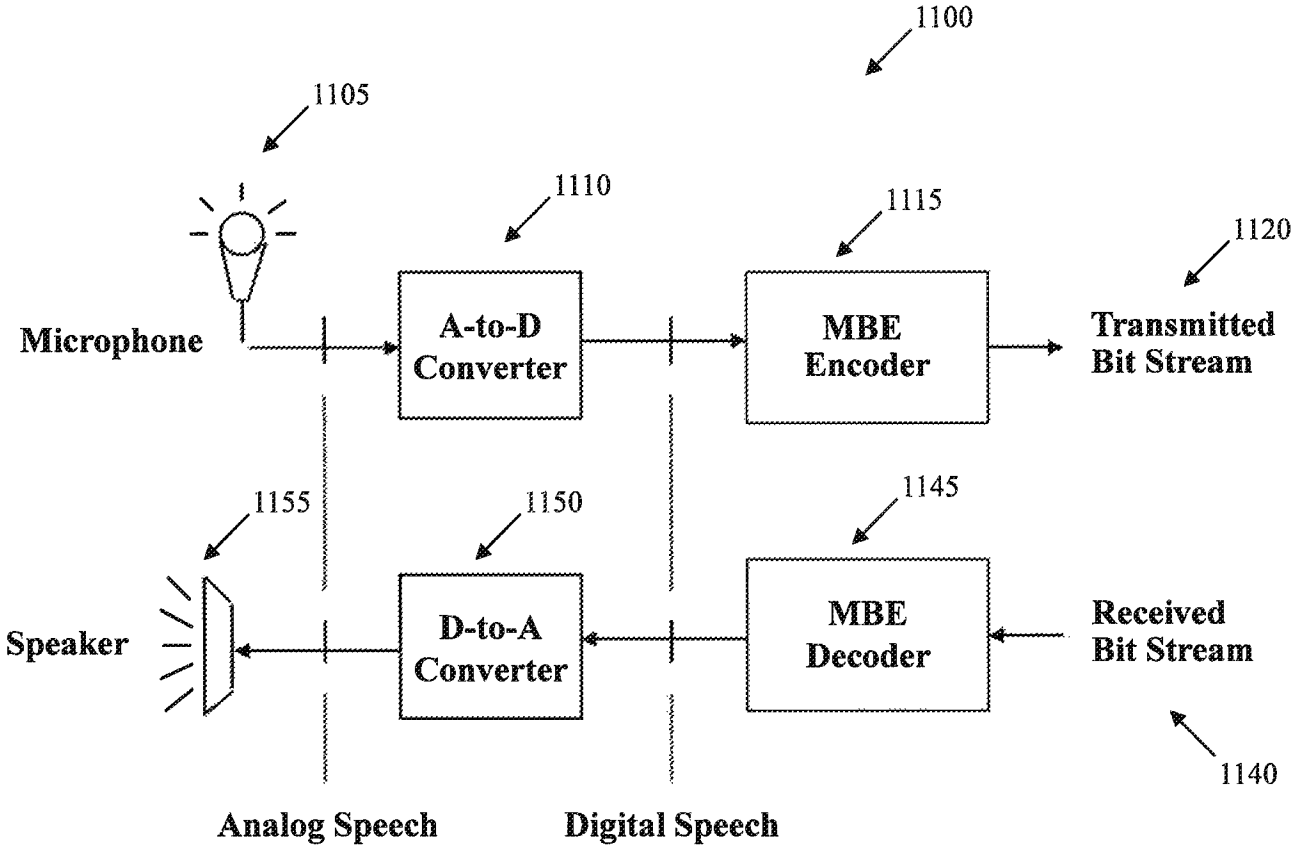
FIG. 11 is a block diagram of a MBE vocoder.

Referring to FIG. 11, the techniques discussed above may be implemented by a speech coder or vocoder system 1100 that samples analog speech or some other signal from a microphone 1105. An analog-to-digital ("A-to-D") converter 1110 digitizes the sampled speech to produce a digital speech signal. The digital speech is processed by a MBE speech encoder unit 1115 to produce a digital bit stream 1120 suitable for transmission or storage. The speech encoder processes the digital speech signal in short frames. Each frame of digital speech samples produces a corresponding frame of bits in the bit stream output of the encoder.

FIG. 11 also depicts a received bit stream 1140 entering a MBE speech decoder unit 1145 that processes each frame of bits to produce a corresponding frame of synthesized speech samples. A digital-to-analog ("D-to-A") converter unit 1150 then converts the digital speech samples to an analog signal that can be passed to a speaker unit 1155 for conversion into an acoustic signal suitable for human listening.

Other implementations are within the scope of the following claims.

What is claimed is:

1. A method of quantizing speech model parameters, the method comprising:

for each of multiple vectors of quantized excitation strength parameters:

determining a first error between a first element of a vector of excitation strength parameters and a first element of the vector of quantized excitation strength parameters, determining a second error between a second element of the vector of excitation strength parameters and a second element of the vector of quantized excitation strength parameters, determining a first energy associated with the first error and a second energy associated with the second error, determining a first weight for the first error and a second weight for the second error such that, when the first energy is larger than the second energy, the ratio of the first weight to the second weight is less than the ratio of the first energy to the second energy, and, when the second energy is larger than the first energy, the ratio of the second weight to the first weight is less than the ratio of the second energy to the first energy, weighting the first error using the first weight to produce a first weighted error and weighting the second error using the second weight to produce a second weighted error, and combining the first weighted error and the second weighted error to produce a total error, comparing the total errors of each of the multiple vectors of quantized excitation strength parameters; and selecting the vector of quantized excitation strength parameters that produces the smallest total error to represent the vector of excitation strength parameters.

2. The method of claim 1, wherein determining the first weight and the second weight include applying a nonlinearity to the first energy and the second energy, respectively.

3. The method of claim 2, wherein the nonlinearity is a power function with an exponent between zero and one.

4. The method of claim 1, wherein the first element of the vector of excitation strength parameters corresponds to an associated frequency band and time interval, and the first weight depends on an energy of the associated frequency band and time interval and an energy of at least one other frequency band or time interval.

5. The method of claim 4, further comprising increasing the first weight when an excitation strength is different between the associated frequency band and time interval and the at least one other frequency band or time interval.

6. The method of claim 1, wherein the vector of excitation strength parameters includes a voiced strength/pulsed strength pair, and the first weight is selected such that the error between a high voiced strength/low pulsed strength pair and a quantized low voiced strength/high pulsed strength pair is less than the error between the high voiced strength/low pulsed strength pair and a quantized low voiced strength/low pulsed strength pair.

7. The method of claim 1, wherein the vector of excitation strength parameters corresponds to a MBE speech model.

8. A method of estimating speech model parameters from a digitized speech signal, the method comprising:

dividing the digitized speech signal into two or more frequency band signals;

determining a first preliminary excitation parameter using a first method that includes performing a nonlinear operation on at least two of the frequency band signals to produce at least two modified frequency band signals, determining weights to apply to the at least two modified frequency band signals, and determining the first preliminary excitation parameter using a first weighted combination of the at least two modified frequency band signals;

determining a second preliminary excitation parameter by applying weights corresponding to the weights determined in the first method to the at least two of the frequency band signals to form a second weighted combination of at least two frequency band signals and using a second method different from the first method to determine the second preliminary excitation parameter from the second weighted combination; and using the first and second preliminary excitation parameters to determine an excitation parameter for the digitized speech signal.

9. The method of claim 8, wherein determining the weights includes examining estimated background noise energy.

10. The method of claim 8, further comprising determining a third preliminary excitation parameter by comparing energy near a peak frequency to total energy and using the first, second and third preliminary excitation parameters to determine the excitation parameter for the digitized speech signal.

11. The method of claim 10, wherein the peak frequency is determined after excluding frequencies below a threshold level.

12. The method of claim 8, further comprising determining a third preliminary excitation parameter using a measure of periodicity over less than the fill bandwidth of the digitized speech signal and using the first, second and third preliminary excitation parameters to determine the excitation parameter for the digitized speech signal.

13. The method of claim 8, further comprising determining a fundamental frequency for the digitized speech signal.

14. The method of claim 13, further comprising determining a target frequency based on previous fundamental frequency estimates.

15. The method of claim 14, further comprising selecting a subharmonic of a current fundamental frequency based on proximity to the target frequency.

16. The method of claim 8, wherein the first preliminary excitation parameter is a fundamental frequency estimate.

17. The method of claim 16, wherein the fundamental frequency estimate is determined by evaluating parameters for at least a first fundamental frequency estimate and a second fundamental frequency estimate.

18. The method of claim 17, further comprising comparing a ratio of the parameter for the second fundamental frequency estimate to the parameter for the first fundamental frequency estimate to a sequence of two or more threshold parameters.

19. The method of claim 18, wherein success for a comparison results in additional parameter tests and failure results in comparing the ratio to the next threshold parameter in the sequence.

20. The method of claim 19, wherein failure of the additional parameter tests also results in comparing the ratio to the next threshold parameter in the sequence.

21. The method of claim 8, wherein the excitation parameter corresponds to a MBE speech model.

22. A speech coder configured to quantize speech model parameters, the speech coder being operable to:

for each of multiple vectors of quantized excitation strength parameters:

determine a first error between a first element of a vector of excitation strength parameters and a first element of the vector of quantized excitation strength parameters, determine a second error between a second element of the vector of excitation strength parameters and a second element of the vector of quantized excitation strength parameters, determine a first energy associated with the first error and a second energy associated with the second error, determine a first weight for the first error and a second weight for the second error such that, when the first energy is larger than the second energy, the ratio of the first weight to the second weight is less than the ratio of the first energy to the second energy, and, when the second energy is larger than the first energy, the ratio of the second weight to the first weight is less than the ratio of the second energy to the first energy, weight the first error using the first weight to produce a first weighted error and weight the second error using the second weight to produce a second weighted error, and combine the first weighted error and the second weighted error to produce a total error;

comparing the total errors of each of the multiple vectors of quantized excitation strength parameters; and select the vector of quantized excitation strength parameters that produces the smallest total error to represent the vector of excitation strength parameters.

23. The speech coder of claim 22, wherein the speech coder is operable to determine the first weight and the second weight by applying a nonlinearity to the first energy and the second energy, respectively.

24. The speech coder of claim 23, wherein the nonlinearity is a power function with an exponent between zero and one.

25. The speech coder of claim 22, wherein the first element of the vector of excitation strength parameters corresponds to an associated frequency band and time interval, and the first weight depends on an energy of the associated frequency band and time interval and an energy of at least one other frequency band or time interval.

26. The speech coder of claim 25, wherein the speech coder is further operable to increase the first weight when an excitation strength is different between the associated frequency band and time interval and the at least one other frequency band or time interval.

27. The speech coder of claim 22, wherein the vector of excitation strength parameters includes a voiced strength/pulsed strength pair, and the speech coder is operable to select the first weight such that the error between a high voiced strength/low pulsed strength pair and a quantized low voiced strength/high pulsed strength pair is less than the error between the high voiced strength/low pulsed strength pair and a quantized low voiced strength/low pulsed strength pair.

28. The speech coder of claim 22, wherein the vector of excitation strength parameters corresponds to a MBE speech model.

29. A handset or mobile radio including the speech coder of claim 22.

30. A base station or console including the speech coder of claim 22.

* * * * *